United States Patent [19]

Newlon

[11] 4,049,934

[45] Sept. 20, 1977

[54] SECURITY HINGE HAVING ADJUSTABLE CAM OPERATOR AND RECIPROCABLE CAM FOLLOWER ACTUATED SWITCH

[75] Inventor: Robert L. Newlon, Sterling, Ill.

[73] Assignee: Lawrence Brothers Inc., Sterling, Ill.

[21] Appl. No.: 710,094

[22] Filed: July 30, 1976

[51] Int. Cl.[2] ..... H01H 3/16

[52] U.S. Cl. ..... 200/61.7

[58] Field of Search ..... 200/61.7, 61.81, 61.82

[56] References Cited

U.S. PATENT DOCUMENTS

| | | | |
|---|---|---|---|
| 3,715,537 | 2/1973 | Peterson | 200/61.7 |
| 3,729,603 | 4/1973 | Foltz | 200/61.7 |
| 3,803,375 | 4/1974 | Foltz | 200/61.7 |
| 3,838,234 | 9/1974 | Peterson | 200/61.7 |
| 3,840,715 | 10/1974 | Gwozdz | 200/61.7 |

FOREIGN PATENT DOCUMENTS

| | | | |
|---|---|---|---|
| 1,279,831 | 6/1972 | United Kingdom | 200/61.7 |
| 1,333,034 | 10/1973 | United Kingdom | 200/61.7 |

OTHER PUBLICATIONS

Grayhill Inc. Engineering Catalog G-374AR2; copyrighted, 1974, title page, pp. 57 and 72.

*Primary Examiner*—James R. Scott
*Attorney, Agent, or Firm*—Olson, Trexler, Wolters, Bushnell & Fosse, Ltd.

[57] ABSTRACT

There is disclosed a security hinge construction comprising a pair of hinge leafs adapted for attachment to a door or a door frame, or the like. Each leaf includes at least one knuckle which is disposed adjacent to and is moveable relative to the knuckle on the other of said leaves. An electrical circuit component such as a switch, is carried by one of the knuckles, with operating means being carried by the other of said knuckles, and with an actuator member disposed therebetween. Upon movement of the hinge leaves the operating means will move relative to the circuit component and the actuator means to activate said switch, as an indication of a change in the relative orientation of said hinge leaves.

12 Claims, 10 Drawing Figures

FIG. 3
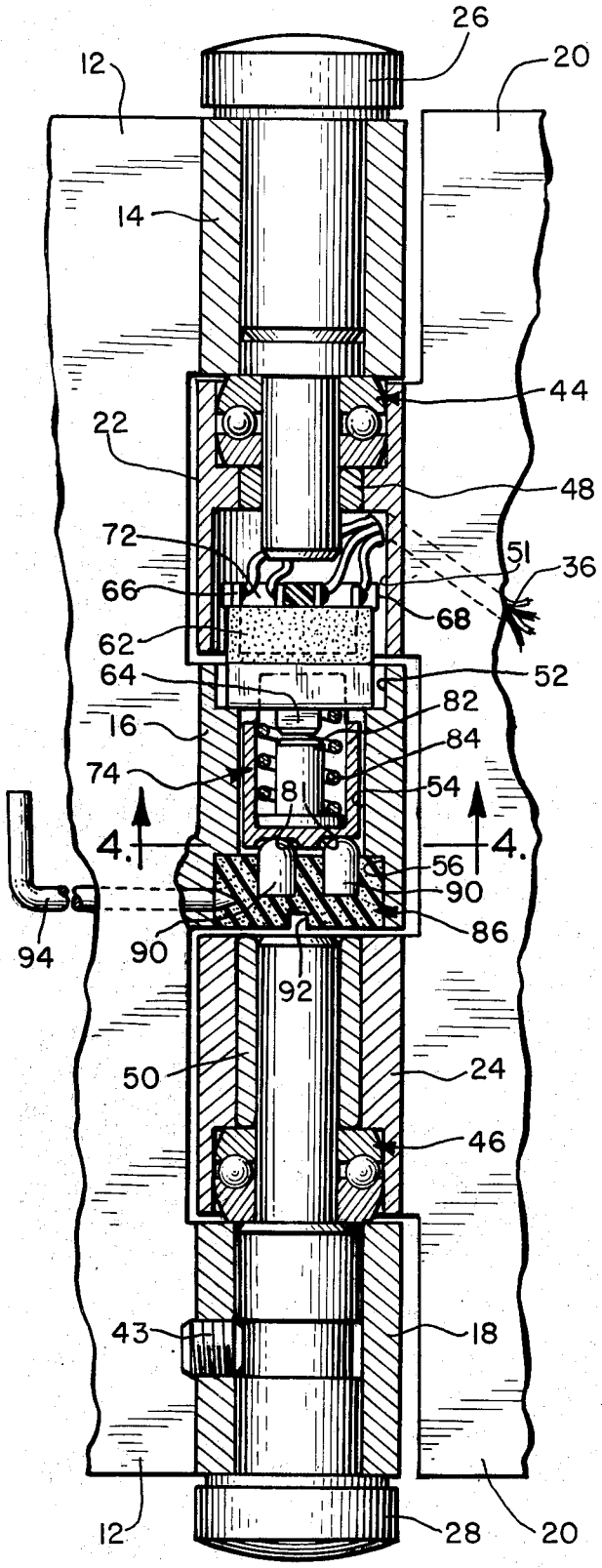
FIG. 4
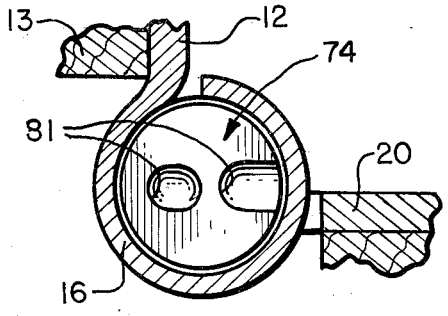
FIG. 3a
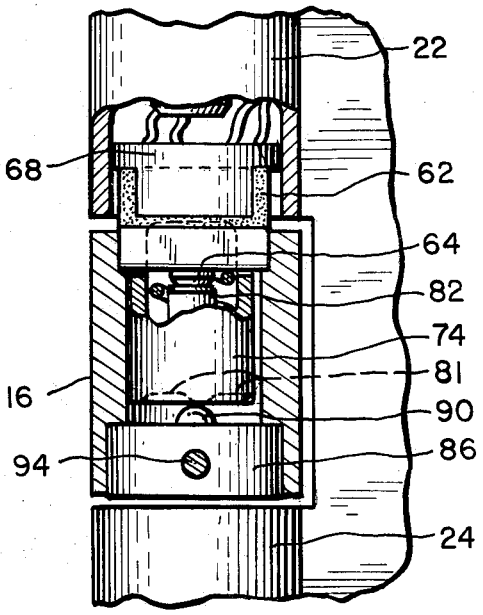
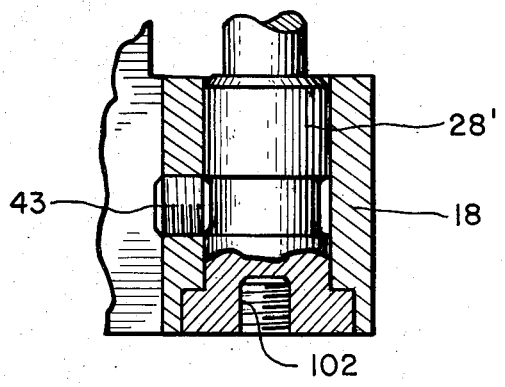
FIG. 9

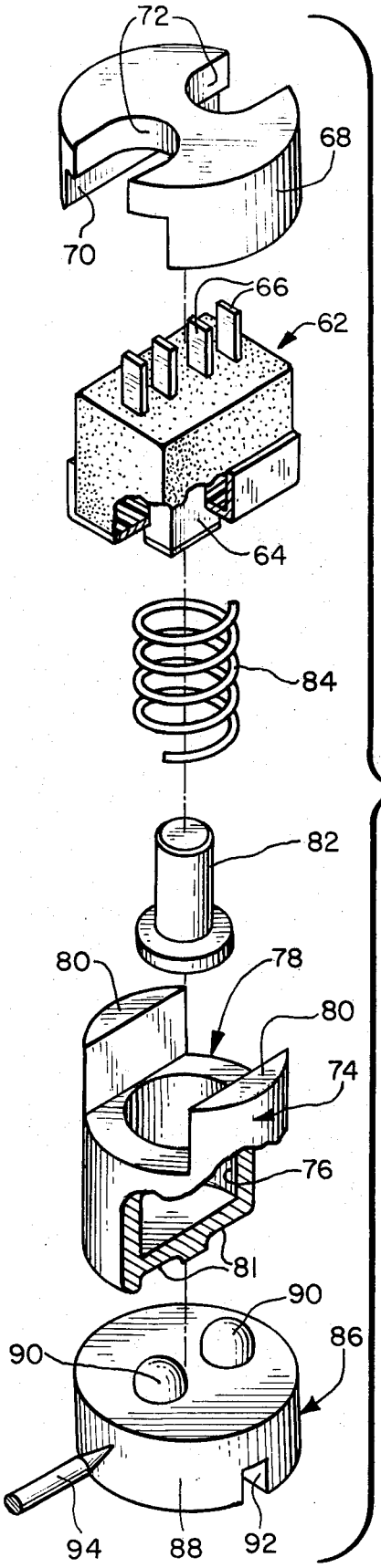
FIG. 7
FIG. 8
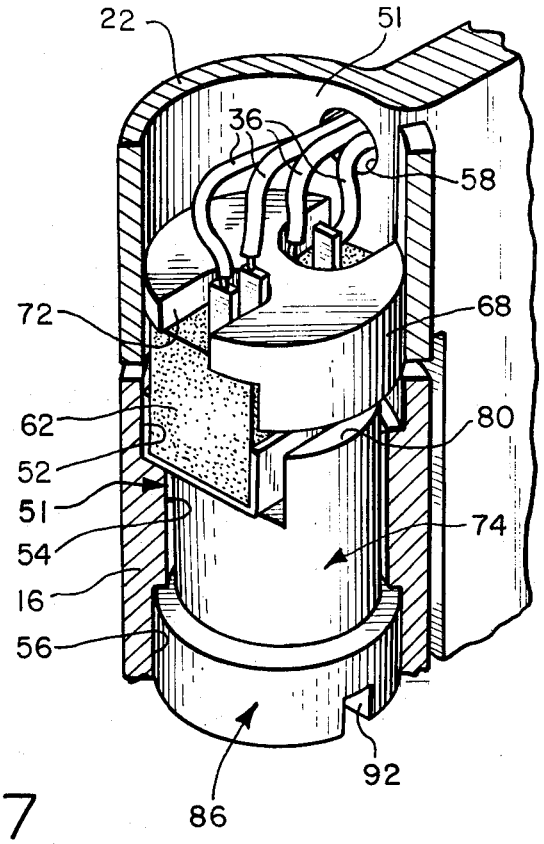

SECURITY HINGE HAVING ADJUSTABLE CAM OPERATOR AND RECIPROCABLE CAM FOLLOWER ACTUATED SWITCH

BACKGROUND OF INVENTION

The present invention pertains to a hinge construction, and more particularly to a hinge construction wherein there is employed a concealed electrical component, such as a switch, which can be placed in connection with an electrical circuit to provide an indication as to the opening and closing of a door member with which the hinge is associated.

More specifically, in certain situations, such as building security, building environment control, it is desirable to monitor the building doors, and provide some indication as to their relative positioning, that is, whether the door is ajar, fully closed, or fully opened. Prior to the present invention, hinge constructions were employed wherein a switch or the like was mounted directly to the hinge leaves, note for example U.S. Pat. No. 3,729,603, U.S. Pat. No. 3,715,537 and U.S. Pat. No. 3,803,375. These prior art arrangements, normally utilized a construction wherein a spring biased switch plunger would extend through an aperture formed in one of the leaves, so that the plunger would be depressed when the leaves were in an adjacent or closed condition, but would be allowed to move outwardly as the door was opened. These units, however, are not concealable as is desired in security situations, as the nature or existence thereof can be easily detected when the door is in the open condition.

The present invention provides a novel and practical design for a security hinge, wherein the switch or other component is entirely housed within the hinge knuckles, yet a generally conventional looking hinge is provided. Accordingly, upon assembly of the hinge to a door and door frame arrangement, neither the switch components nor the lead wires are visible, even when the leaves are in a separated or open condition.

As a further matter, the present invention provides a design which enables the sensitivity of the security hinge to be adjusted, and adapted to the desired use. In this regard, at least one of the operating components of the assembly, is adjustably positioned so that before the door has been mounted, the element can be positioned to provide for operation of the switch immediately upon opening, or after a specified degree of opening movement, or only after the door has been fully opened.

While the present invention will be disclosed with regard to a switch, it is envisioned that other electrical components could be employed, such as a variable resistor, the only requirement being that the condition of the component be alterable so that detection of a change of position can be achieved through use of an electrical circuit, to which the component is attached.

BRIEF DESCRIPTION OF THE DRAWINGS

The above-noted advantages will be more apparent from the following detailed description of the disclosed embodiments, which will be presented in conjunction with the accompanying drawings, wherein:

FIG. 3 is a sectional view of the hinge barrel, with the monitoring components in the door-closed condition, for purposes of illustration the hinge leaves have been shown separated.

FIG. 3*a* is a partial sectional view similar to FIG. 3, but illustrating the door-open condition which produces operation of the switch plunger.

FIG. 4 is a partial section view illustrating the construction of the cam surface on the actuator member;

FIG. 7 is an exploded perspective of the monitoring assembly which is disposed within the knuckle bores;

FIG. 8 illustrates the components of FIG. 7 in the assembled condition.

FIG. 9 is a partial sectional view of an alternate hinge design, wherein a flush-tipped pintle pin is employed.

DESCRIPTION OF THE ILLUSTRATED EMBODIMENT

Figure 1:
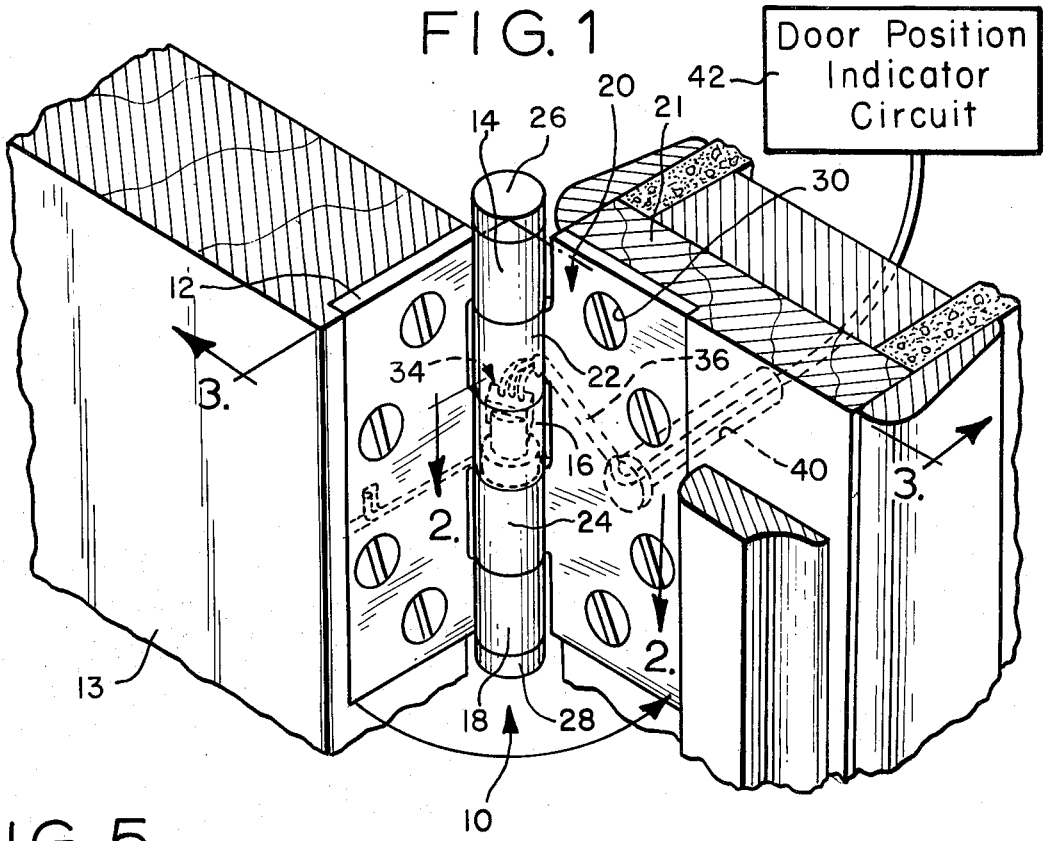
FIG. 1 is a partial perspective view illustrating a switch in accordance with the present invention mounted to a door and door frame assembly, with the door in the open condition.

Attention is initially directed to FIG. 1 wherein the hinge 10 of the present invention is shown in the assembled condition. The components of general overall monitoring assembly of the hinge 10, which are normally concealed from view, are shown in dotted outline, and will be discussed in more detail hereinafter.

Basically, the hinge 10 is of a conventional design, which is intended so as to conceal the existence of the monitoring components. In this regard, said hinge 10 includes a first leaf 12 attached to a door 13, and having knuckles 14, 16 and 18. A mating leaf 20 is provided, which is affixed to a door frame or jam 21, which leaf includes knuckles 22 and 24 disposed or engaged between the aforementioned knuckles 14, 16 and 18 in the conventional manner. The leaves and the respective knuckles are maintained in assembled condition, by hinge pins or pintles 26 and 28. Further, the leaves 12 and 20 also include a series of apertures 30, in which wood screws, or the like, 32 may be disposed to mount the hinge leaves to the door and door frame, respectively.

With continued reference to FIG. 1, the monitoring apparatus, which is designated generally 34, is shown in phantom outline. It should be noted that this apparatus 34 is contained entirely within the hinge knuckles 16 and 22, and as such is not exposed to view or detection. Lead wires 36 for the electrical circuit component of the apparatus 34 pass out of the leaf 20 and through a suitable aperture 40 formed in the door jam, for connection to a position indicator circuit 42.

While various types of circuit components may be employed, the present invention has been illustrated with regard to a switch, which can easily be wired either as a normally closed, or a normally opened switch. The switch is connected to the indicator circuit 42, in such a manner that upon operation thereof said circuit will provide a visual, audio or some other form of indication as to the door condition, that is, opened, closed or any position therebetween.

Attention is now directed to the FIG. 3, wherein the monitoring assembly 34 is illustrated in detail in its assembled condition interiorly of the knuckles of the hinge 10. As mentioned above, hinge 10 is basically a commercial type hinge, which has been modified to accommodate the novel monitoring assembly 34. With reference to the conventional nature of the hinge 10, the aligned hinge knuckles and the corresponding hinge leaves 12 and 20 are maintained in the assembled condition by the use of hinge pins or pintles 26 and 28 which are disposed within adjacent overlapped knuckles. That is to say, the upper hinge pin 26 passes through knuckles 14 and 22, while the lower hinge pin 28 is disposed and the knuckles 18 and 24, with a set screw 43 maintaining said lower pin in position. In the form of the hinge 10 as illustrated in the drawings, ball bearing assemblies 44 and 46 are disposed in recesses formed in the knuckles 22 and 24 of the leaf 20. In addition, bearing sleeves 48 and 50 are employed in surrounding relation to the hinge pins 26 and 28. Both of the above-noted features are known in the art, and serve to provide a smooth working, dependable hinge.

As can be seen from FIG. 3, the hinge pins 26 and 28 do not extend into the middle knuckle 16, nor does the pin 26 extend completely through the knuckle 22, which knuckle 16 and 22 have been modified to accommodate the monitoring assembly 34. In this regard, the knuckle 22 is provided with an enlarged bore 51 disposed axially of the bearing sleeve 48. Correspondingly, the middle knuckle 16 has had its bore enlarged in a somewhat stepped fashion, so as to provide three distinct bore sections or areas, identified by reference characters 52, 54 and 56. The specific construction of the preferred form of monitoring assembly 34 illustrated in the drawings will be discussed in detail with regard to FIG. 7 and 8. However, it should be noted that basically the monitoring assembly 34 includes some form of electrical component, such as a switch, which is responsive to mechanical motion so as to provide a change in the characteristics of the electrical circuit to which it is attached. In addition to the electrical circuit component, the invention contemplates the use of actuating means for producing the above-mentioned response or change as an incident to the relative movement of the hinge leaves 12 and 20, as would occur upon the opening or closing of the door 13. In this regard, it should be kept in mind, that while preferred form of actuating means is illustrated and discussed in detail hereinafter, the invention is not specifically limited thereto. Indeed there is contemplated other forms of actuator means and circuit components.

Figure 2:
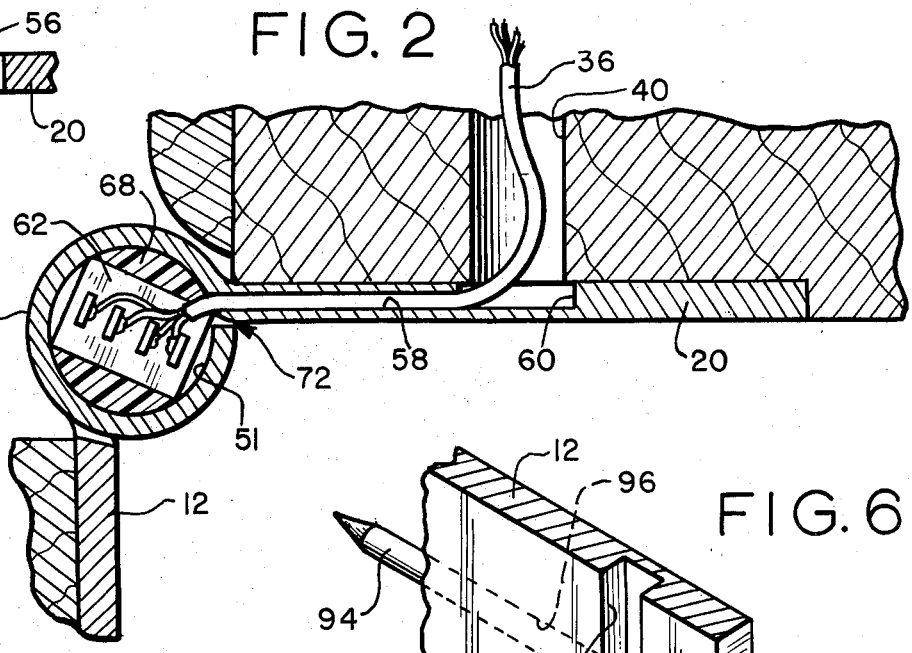
FIG. 2 is a sectional view taken along the line 2—2 of FIG. 1.

Since the electrical component of the assembly 34 is wired into a detecting or indicator circuit 42, as discussed previously, the leaf 20 which is formed integral with the knuckle 22, is provided with a passage 58, note FIG. 2, which extends generally parallel to the surface of the leaf, and opens into the recess 51. A transverse bore 60 is formed in the rear surface of the leaf 20, which bore intersects the passage 58 and in effect provides an outlet through the rear face of said leaf. The lead wire or wires 36 from the electrical component of assembly 34, can thus pass from the bore 50 into passage 58, and from there it can exit the leaf through the bore 60. As was discussed above, the wire leads 36 then pass through the opening 40 formed in the door frame or jam 21 for connection to the circuit 42.

Attention is now invited to FIGS. 7 and 8, wherein a preferred form of monitoring assembly 34 is illustrated in detail. In this regard, FIG. 8 shows the assembly 34 is exploded or unassembled relation, while FIG. 8 is essentially an enlarged perspective of the assembly 34 as shown in FIG. 3 with the various components thereof in their operating or assembled condition. As such, a discussion of the preferred embodiment of the monitoring assembly 34 will follow in conjunction with both FIGS. 7 and 8.

Basically, the monitoring assembly 34 includes a switch or some other form of electrical circuit component 62 which has an operating plunger 64 or the like, and a series of terminals 66. In the illustrated embodiment, a switch of generally known, conventional construction is illustrated. The switch 62 is mounted in a carrier or mounting element 68 which is provided with a channel 70 and opening 72 to accommodate the switch 62 and leads 66 as is shown in FIG. 8. The outer diameter of the carrier element 68 is preferably formed so as to provide a slight friction fit with the bore 50 when assembled therein, which friction fits serve to maintain in the axial position of the switch 62 and carrier 68. The relative rotational position of the switch 62 with respect to the bore 50 is maintained by disposing an exposed corner of the switch 62 in engagement with the seam or parting lines 72 of the knuckle, as is shown in FIG. 2. Thus, the switch 62 is in effect locked in position with respect to the knuckle 22 and cannot rotate or move axially thereof.

The monitoring assembly 34 further includes an operating or actuator arrangement which in effect converts the relative rotation occurring between the hinge knuckles upon opening or closing of the door, into linear movement sufficient to produce operation of the switch plunger 64. In this regard, there is provided an actuator housing or piston 74 which is shown partially broken away in FIG. 7, and includes a central recess or socket 76 and a cross-slot 78, the latter of which defines a pair of axially extending flange members 80. The lower end surface of the housing or piston 74 is provided with a pair of depressions or cam detents 81, which are best viewed in FIG. 4. The actuator arrangement as shown in the drawings further includes a post element 82 which is seated within the socket 76, with a spring member 84 disposed about said post element, said spring member also being received within the socket 76, which arrangement is best viewed in FIG. 3. A cam or operating member 86 is also provided, which is capable of providing linear movement of the housing 74. The exact function and purpose of the various components of the actuator arrangement will become clear upon a detailed discussion of the operation of the device, which will follow hereinafter in conjunction with FIGS. 3 and 3*a*.

With specific reference to FIG. 8, it should be noted that while the switch component 62 is carried by the knuckle 22, a portion thereof extends axially into the bore 52 formed in the adjacent knuckle 16. The actuator housing 74, in the preferred embodiment, is entirely disposed within the knuckle 16 with the switch 62 received within the cross-slot 78 with flange members 80 being disposed on opposite sides of said switch 62. Accordingly, the actuator housing 74 is in effect keyed to the switch 62, so that it cannot rotate relative thereto, said housing 74 is, however, free to move axially or linearly thereof, within certain limits. Obviously, since switch 62 is fixed with respect to knuckle 22 and the housing 74 is keyed to the switch 62, the respective dimensions of the components 62 and 74 are such that relative movement with respect to the bores 52 and 54 in knuckle 16, can take place.

Attention is now directed to the cam or operating element 86. Cam element 86 in the preferred, illustrated embodiment is comprised of a base 88 formed of an elastomeric material, which material is relatively soft, and capable of being penetrated by a sharp pin, or the like. The base 88 has one or more cam members 90 disposed or embedded therein, with the upper surfaces thereof extending above that of said base 88. In addition, the base 80 also includes a tool receiving recess 92, which in the illustrated embodiment is in the form of a slot adapted to receive a screw driver blade or the like. Again, the purpose to this slot and the other components of cam element 86 will be discussed hereinafter.

The cam element 86 is disposed within the bore 56 formed in knuckle 16, as shown in FIG. 8. In the initial assembled condition, as shown in FIG. 3, the cam members 90 are in engagement with the underside of the actuator housing 74, and are received within the detents 81 formed in said housing 74. The operation of the device requires that relative movement be attained between the cam element 86 and the actuator housing 74. To achieve this relative movement, it is necessary to the position of the cam element 86 with respect to the bore 56, so that said cam element 86 will move with the knuckle 16, to produce linear movement of housing 74.

Figure 5:
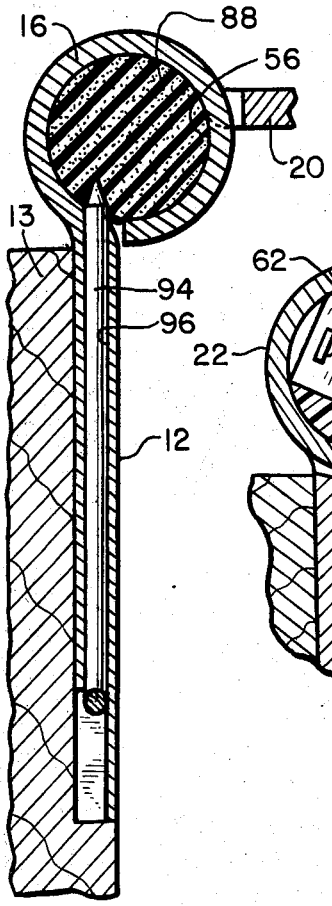
FIG. 5 is a partial sectional view illustrating the pin device utilized to fix the position of one of the operating elements of the monitoring assembly.
Figure 6:
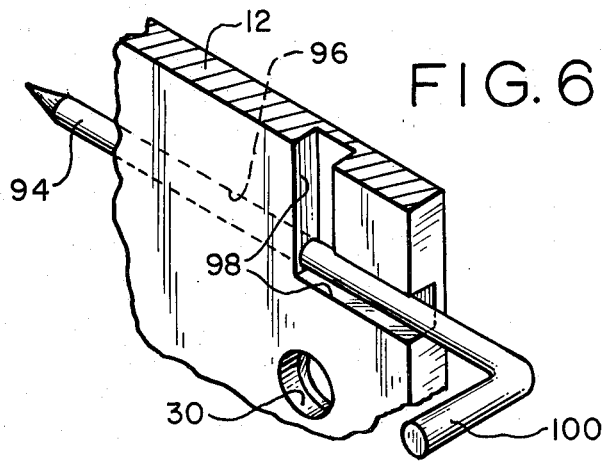
FIG. 6 is a partial, perspective view illustrating one form of adjustment means that can be employed.

Before discussing the basic operation of the device, a preferred form of means for fixing the positioning of the cam element 86, and also attaining adjustment thereof will now be considered, with regard to FIGS. 6 and 7. In this regard there is provided a pin 94 which includes a sharp tip which is embedded in the relatively soft matrix of the base 88 of said cam element as is best seen in FIGS. 5 and 6. The pin 94 is carried in a bore or passage 96 formed in the hinge plate 12, one end of the passage opens into the bore 56 in knuckle 16, while the other end of passage 96 opens to an L-shaped slot 98 formed in the rear face of the hinge leaf 12. The pin 94 is slidably mounted in the passage 96, so that it may selectively be brought into engagement with the base 88. The end of the pin 94 opposite the sharp point, is provided with a right-angle bend, which in effect provides a handle portion 100 which facilitates manipulation of the pin 94 as desired.

FIG. 6 illustrates the pin 94 in the retracted position, i.e. out of engagement with the cam element 86, so that the position of the cam element 86 may be adjusted as desired. Once the desired or initial position for the cam element 86 is selected, pin 94 is moved axially of the bore 96 to embed the point thereof within the base 88, thereby fixing both the axial and rotative position of said cam element 86 with respect to the knuckle 16. The pin 94 may now be rotated relative to the bore 96 so as to dispose the handle 100 in the vertical leg or segment of the slot 98 as shown in FIGS. 1 and 5, thereby locking the pin 94 in position, and precluding undesired retraction thereof.

The operation of the hinge construction as discussed above will now be considered in conjunction with FIGS. 3 and 3*a.* As noted above FIG. 3 illustrates which will be termed for discussion purposes, the primary condition of the monitoring assembly 34 which is attained during the door-closed condition. Accordingly, in this primary condition the cam elements 90 are disposed in the detents 81, with the spring 84 biasing the housing 74 axially downward to insure engagement of the end surface thereof with the cam element 86. The plunger 64 of the switch element 62 is thus in its extended position, with the end of the post element 82 being in alignment therewith. Accordingly, assuming a normally open switch 62, the indicator circuit 42, which may include a light (not shown) or some other form of indicator will be open providing an indication that the door 13 is in the closed condition.

Upon movement of the door from the door-closed condition of FIG. 3 to the door-open condition, relative rotatable movement between knuckle 16 and 20 will occur. This relative movement will in turn produce relative rotation of the cam element 86 with respect to the actuator housing 74, causing the cam members 90 to move out of the cam detents 81 into engagement with the planer end surface of the housing 74 proximate said detents, as is shown in FIG. 3*a.* Due to the maintaining of the axial position of the cam element 86 by the pin 94 during relative movement, as the cam members 90 move out of the cam detents 81, the actuator housing 74 and post 82 will be moved or biased upwardly against the action of the spring 84. This movement will cause the post 82 to depress the switch plunger 64, as shown in FIG. 3*a,* thereby producing a closed condition for the normally open switch 62 as the door becomes ajar. The cam members 90 will remain out of engagement with the detents 81 as the door continues to move from the door-closed position toward the door-open position. Similarly the switch 62 remains depressed, i.e. closed, during this movement.

It is envisioned that the switch element 62 could be wired as a normally open switch or as will be explained hereinafter, the relative position of the cam element 86 or the size of detents 81 can be adjusted so that depression of the switch plunger 64 is achieved at any desired point in the path of movement toward the door-open condition, rather than immediately upon the door becoming ajar. As a further point, it is also envisioned that circuit components other than switch 62 may be utilized, or that the switch 62 could be employed to provide different circuit paths upon the operation of the plunger, rather than merely obtaining an open or closed condition for the switch contacts.

As was eluded to previously, sensitivity of the monitoring assembly, as well as the initial adjustment thereof to determine at what point in the movement of the door the switch 62 is operated, can easily be attained with the hinge construction 10 of the present invention. A discussion of this aspect of the invention will now be undertaken, with regard to the basic steps that would be followed in a typical installation. In this regard, it will be assumed that the switch 62 is of the normally open type, and that the indicator circuit 42 is being employed in a security system to provide an indication as to when the door 13 is in a position other than the door-closed condition.

Initially, the hinge leaf 20 would be assembled to the door frame 21 with the leaf 12 remaining unattached. In this condition, the lead or leads 36 would be connected to the indicator circuit 42, and said circuit connected to a suitable power source so that it can provide an indication as to when the switch plunger 64 is depressed. With the leaf 12 unattached, the installer can easily unlatch the pin 94 and retract same to free the cam element 86. Next, the set screw 43 is retracted, and the lower hinge pin 28 is removed. With the hinge pin 28 removed, the installer can then insert a tool, such as a screw driver or some other suitably shaped key, into the knuckle bore and engage said tool in the service recess or slot 92. When this is done, the cam element 86 can be manipulated to adjust its orientation in relation to position of hinge leaf 12 with respect to leaf 20, as needed.

Assuming that it is desired to provide an immediate visual indication as to the initial movement of the door from the door-closed position, the hinge leaf 12 is moved to a position corresponding to that achieved upon reaching the door-closed condition. By employment of the service tool (not shown) the installer can then manipulate the cam element 86 and by use of the indicator circuit, can adjust the relative position of said cam element 86 so that switch 62 is open when the door is closed, i.e. the components are in the condition as shown in FIG. 3. Once the desired or proper position for the cam element 86 is attained, the pin 94 is re-engaged with the cam element base 88 and the handle 100 again locked into the L-shaped slot 98 to fix the relative position of said cam element 86 with respect to the knuckle 16. Accordingly, upon movement of the leaf 12 away from leaf 20, as would occur during opening of the door, cam element 86 will rotate. This rotation will cause the cam members 90 to move out of detents 81, biasing the housing 74 upward to depress the switch plunger 64, and causing the switch 62 to assume a closed condition. The initial adjustment of the monitoring assembly 34 thus being completed, the hinge plate 12 can then be attached to the door 13.

With regard to FIG. 9, there is disclosed a slight modification in the construction of the hinge pins 26 and 28. It should be noted that the hinge pins 26 and 28 in the embodiment as discussed, are of the conventional "button" type, which include a head portion exteriorally of the knuckle to facilitate removal. Quite often in security applications flush-type pins are used, viz. no exposed head portion. In FIG. 9, the pin 28 ' is of the flush-type and is provided with a tapped recess 102 in the end fac thereof. Accordingly, when it is necessary to remove pin 28', a suitably threaded tool can be engaged in the recess 102 to enable removal of said pin 28'.

In summary, there has been disclosed one form of novel hinge construction, employing a monitoring arrangement entirely concealed within the bore provided by the respective hinge knuckles. A preferred form of the novel hinge arrangement has been disclosed, with regard to specific cam element, a switch-type circuit component, and an actuator arrangement for obtaining the operation thereof. It is indeed intended that these components may be varied, or altered to suit the intended use for the hinge. Accordingly, it is envisioned that others skilled in the art, once possessing knowledge of the present invention, may devise various alterations and modifications which do not depart from the spirit and scope of the invention as defined in the claims appended hereto. Insofar as said alterations and modifications fall within said claim they are indeed covered by the present invention.

The invention is claimed as follows:

1. A hinge construction comprising first and second pivotally connected hinge leafs, each said leaf including means adapting same for attachment to a door or a door frame, or the like, each leaf further including at least one knuckle which is disposed adjacent to and is movable relative to the knuckle on the other of said leaves, an electrical circuit component carried by one of said knuckles, actuator means associated with said circuit component, and capable of producing a change in condition thereof, operating means carried by the other of said knuckles, such that upon movement of said hinge leaves relative to each other, said operating means will be moved relative to said circuit component and said actuator means to operate said actuator means and thereby produce a change in the condition of said electrical circuit component, which change in condition may be used as an indication of a change in the relative orientation of said hinge leaves, said actuator means comprising a movable plunger on said component for altering the condition thereof, and piston means non-rotatably mounted with respect to said circuit component, but being movable axially with respect to said circuit component for engagement and operation of said plunger, said piston means including cam means on the end thereof remote from said circuit component, said operating means carried by the other of said hinge knuckles comprising a member adapted to be fixedly positioned with respect to said other knuckle for movement therewith relative to said circuit component and said piston means; said member including cam means formed thereon engageable with the cam means on piston means to produce axial movement thereof and operation of said plunger, as an incident to movement of said hinge leaves.

2. A hinge construction as defined in claim 1, wherein said electrical circuit component is a switch and there is provided lead wires extending exteriorally of said hinge adapting said switch for connection in an electrical circuit.

3. A hinge construction as defined in claim 1, wherein said operating means member is formed from a relatively soft, penetrable material, and there is further provided pin means carried by said leaf having said one knuckle formed thereon, which pin may be inserted in said member to fix the position thereof relative to said hinge knuckle within which it is disposed.

4. A hinge construction according to claim 1, further including means for adjustably fixing the position of said operating means member so as to provide an initial positioning upon a pre-selected orientation of said hinge leaves.

5. A hinge construction according to claim 4, wherein said means for adjustly fixing said operating means member includes a recess formed in the end thereof opposite that having said cam means formed thereon, which recess is adapted to receive a tool in mating engagement therewith so that upon rotation of said tool, the position of said member relative to said knuckle within which it is disposed may be adjusted, and pin means for locking said member in position once the desired orientation is achieved.

6. A hinge construction comprising first and second hinge leafs, each leaf including at least one hinge knuckle which knuckles are juxtaposed in the assembled condition, means for maintaining said hinge leaves in an assembled condition, and an electrical switch carried within one of said knuckles and including a plunger for the operation thereof, operating means carried within the other of said knuckles, and actuator means disposed between said operator means and said switch plunger, which actuator means is operatively and non-rotatably engaged with said switch, while being free to move axially to achieve movement of said plunger, and cam means carried by said operating means and said actuator means capable of producing axial movement of said plunger upon relative movement of said hinge leaves, as would be occasioned upon the opening or closing of a door, said switch, operating means and actuator means being entirely housed within said juxtaposed knuckles and thus being concealed from view when said hinge is in the assembled condition, said actuator means comprising piston means non-rotatably mounted with respect to said switch, but being movable axially with respect to said switch for engagement and operation of said plunger.

7. A hinge construction comprising first and second hinge leafs, each leaf including at least one hinge knuckle which knuckles are juxtaposed in the assembled condition, means for maintaining said hinge leaves in an assembled condition, and an electrical switch carried within one of said knuckles and including a plunger for the operation thereof, operating means carried within the other of said knuckles, and actuator means disposed between said operator means and said switch plunger, which actuator means is operatively and non-rotatably engaged with said switch, while being free to move axially to achieve movement of said plunger, and cam means carried by said operating means and said actuator means capable of producing axial movement of said plunger upon relative movement of said hinge leaves, as would be occasioned upon the opening or closing of a door, said switch, operating means and actuator means being entirely housed within said juxtaposed knuckles and thus being concealed from view when said hinge is in the assembled condition, said operating means including a member formed from a relatively soft, penetrable material, and there is further provided pin means carried by said leaf having said one knuckle formed thereon, which pin may be inserted in said member to fix the position thereof relative to said hinge knuckle within which it is disposed.

8. A hinge construction comprising first and second hinge leafs, each leaf including at least one hinge knuckle which knuckles are juxtaposed in the assembled condition, means for maintaining said hinge leaves in an assembled condition, and an electrical switch carried within one of said knuckles and including a plunger for the operation thereof, operating means carried within the other of said knuckles, and actuator means disposed between said operator means and said switch plunger, which actuator means is operatively and non-rotatably engaged with said switch, while being free to move axially to achieve movement of said plunger, and cam means carried by said operating means and said actuator means capable of producing axial movement of said plunger upon relative movement of said hinge leaves, as would be occasioned upon the opening or closing of a door, said switch, operating means and actuator means being entirely housed within said juxtaposed knuckles and thus being concealed from view when said hinge is in the assembled condition, said operating means being a member carried by said other knuckle and there is provided means for adjustably fixing the position of said operating means member so as to provide an initial positioning upon a pre-selected orientation of said hinge leaves, said means including a recess formed in the end of said member opposite that having said cam means formed thereon, which recess is adapted to receive a tool in mating engagement therewith so that upon rotation of said tool, the position of said member relative to said knuckle within which it is disposed may be adjusted, and pin means for locking said member in position once the desired orientation is achieved.

9. A hinge construction for attachment of a door to a door frame, or the like, and comprising first and second pivotally connected hinge leaves, an electrical circuit component carried by said hinge, operating means associated with said circuit component and capable of producing a change in condition thereof, said operating means including a member carried by one of said knuckles and movable therewith, such that upon movement of said hinge leaves relative to each other, said member will be moved relative to said circuit component to produce a change in the condition thereof, which change may be used as an indication of a change in the relative orientation of said hinge leaves as would occur upon movement of a door relative to a door frame, means for adjustably fixing the initial position of said operating member with said hinge in the assembled condition and while one of said leaves is attached to the door or door frame, so that the initial condition of said circuit component and the point at which operation of said circuit component takes place, can be selected and/or adjusted at the installation site, said means including a generally cylindrical configuration for said operating member, recess means of corresponding shape formed in said knuckle, with said cylindrical operating member disposed in said recess for rotative movement with respect to said knuckle, pin means carried by the other of said leaves in a bore formed in said leaf and opening into said recess means, said bore opening to a surface of said leaf other than that which can be viewed upon final assembly, thereby providing for selective movement of said pin means, said pin means being engageable with said operating member to fix the relative position thereof and disengageable therefrom to free said member for rotation relative to said recess, and means for selectively rotating said operating member from the exterior of said hinge to achieve a desired orientation of said operating member with respect to said circuit component, with said operating member then locked in position relative to said knuckle by engagement therewith of said pin means, such that when said hinge is finally assembled with respect to a door and door frame installation, said circuit component, said pin means, and said operating member cannot be viewed.

10. A hinge construction according to claim 9, wherein said means for selectively rotating said operating member, comprising, a tool receiving recess formed in an end face of said member, and aligned with the knuckle bore so a tool may be engaged therein through said knuckle bore.

11. A hinge construction according to claim 9, wherein said bore opening into said recess means also opens to a slot formed in a face of said other leaf; said pin means including a transverse portion disposable in said slot to lock said pin in engagement with said operating member.

12. A hinge construction according to claim 9, wherein said operating member is formed from a relatively soft material, and said pin means including a sharp point for penetrating said soft material upon engagement with said member to fix the relative portion thereof, such that said operating member is infinitely adjustable with respect to said other knuckle.

* * * * *

UNITED STATES PATENT AND TRADEMARK OFFICE

Certificate

Patent No. 4,049,934 Patented September 20, 1977

Robert L. Newlon

Application having been made by Robert L. Newlon, the inventor named in the patent above identified, and Lawrence Brothers, Inc., Sterling, Ill., a corp. of Illinois, the assignee, for the issuance of a certificate under the provisions of Title 35, Section 256, of the United States Code, adding the name of Tom M. Lawrence as a joint inventor, and a showing and proof of facts satisfying the requirements of the said section having been submitted, it is this 28th day of April 1981, certified that the name of the said Tom M. Lawrence is hereby added to the said patent as a joint inventor with the said Robert L. Newlon.

FRED W. SHERLING,

*Associate Solicitor.*